US005580157A

United States Patent [19]

Patricca et al.

[11] Patent Number: 5,580,157

[45] Date of Patent: Dec. 3, 1996

[54] HANDLE APPARATUS FOR FLASHLIGHT

[76] Inventors: Thomas R. Patricca; Janet K. Patricca, both of 10426-2 N. 11th Pl., Phoenix, Ariz. 85020

[21] Appl. No.: 394,882

[22] Filed: Feb. 27, 1995

[51] Int. Cl.[6] ..... H04M 1/22

[52] U.S. Cl. ..... 362/191; 362/109; 362/156; 362/253; D26/138

[58] Field of Search ..... 362/191, 102, 362/156, 190, 253, 109; D26/138; 119/795, 859

[56] References Cited

U.S. PATENT DOCUMENTS

| | | | |
|---|---|---|---|
| 2,485,483 | 10/1949 | Cunningham | 362/116 |
| 2,681,979 | 6/1954 | Manoloff | 362/102 |
| 2,694,138 | 11/1954 | Schwinn | 362/102 |
| 4,376,965 | 3/1983 | Bacevius | 362/190 |
| 4,656,566 | 4/1987 | Kelley | 362/109 |
| 5,008,784 | 4/1991 | Wang | 362/116 |
| 5,105,309 | 4/1992 | Baravaglio et al. | 362/102 |
| 5,318,177 | 6/1994 | Isacson | 362/116 |
| 5,343,825 | 9/1994 | Gazecimeon et al. | 362/102 |
| 5,412,545 | 5/1995 | Rising | 362/191 |
| 5,429,075 | 7/1995 | Passarella et al. | 119/795 |

*Primary Examiner*—Denise Gromada
*Assistant Examiner*—Alfred Basichas
*Attorney, Agent, or Firm*—H. Gordon Shields

[57] ABSTRACT

Handle apparatus includes a housing for receiving a flashlight and a hand guard secured to the housing. A leash for walking or exercising an animal may be secured to the hand guard portion. A purse or pouch may also be secured to the hand guard portion for holding keys, change, etc. The housing is grasped by a user, and the users fingers extend into the hand guard portion. An alternate embodiment includes a leg secured to the hand guard portion to define a walking cane. Another alternate embodiment comprises a double cylinder in which the top cylinder comprises a flashlight housing and the bottom cylinder may be secured to a tubular element of a bicycle, walker, wheelchair, etc.

14 Claims, 1 Drawing Sheet

HANDLE APPARATUS FOR FLASHLIGHT

BACKGROUND OF THE INVENTION

1. Field of the Invention

This invention pertains to handles, and, more particularly, a handle for a flashlight to which an animal leash may be secured and which may be utilized as part of a cane.

2. Description of the Prior Art

For walking at night, people typically simply carry a flashlight. The flashlight is used to illuminate the pathway in front of the walker or user. For persons that enjoy walking an animal, such as a dog, at night, typically the animal is on a leash, and the leash is held in one hand and a flashlight is held in the other hand.

The apparatus of the present invention combines a handle which holds a flashlight with provisions for securing a leash to the handle, or for providing a cane or walking stick as an inherent part of the flashlight carrying handle.

SUMMARY OF THE INVENTION

The invention described and claimed herein comprises a generally rectangularly configured handle with a central hollowed area disposed beneath an upper, flashlight holding frame. An animal leash may be secured to the frame, and a pouch may be secured to the bottom of the frame in which keys, etc., may be conveniently carried. A second embodiment includes a walking stick or cane portion extending downwardly from the handle.

Among the objects of the present invention are the following:

To provide new and useful handle apparatus to which a flashlight may be secured;

To provide new and useful handle apparatus to which a flashlight and an animal leash may be secured;

To provide new and useful handle apparatus to which a flashlight, an animal leash, and a purse may be secured;

To provide new and useful handle apparatus for a walking stick to which a flashlight may be secured;

To provide new and useful handle apparatus for a walking cane which includes a flashlight secured to the handle and a purse removably secured to the handle; and To provide new and useful handle apparatus for holding a flashlight and which may be secured to a tubular element.

DESCRIPTION OF THE PREFERRED EMBODIMENT

Figures 1, 2, 3, 4, 5, 6:
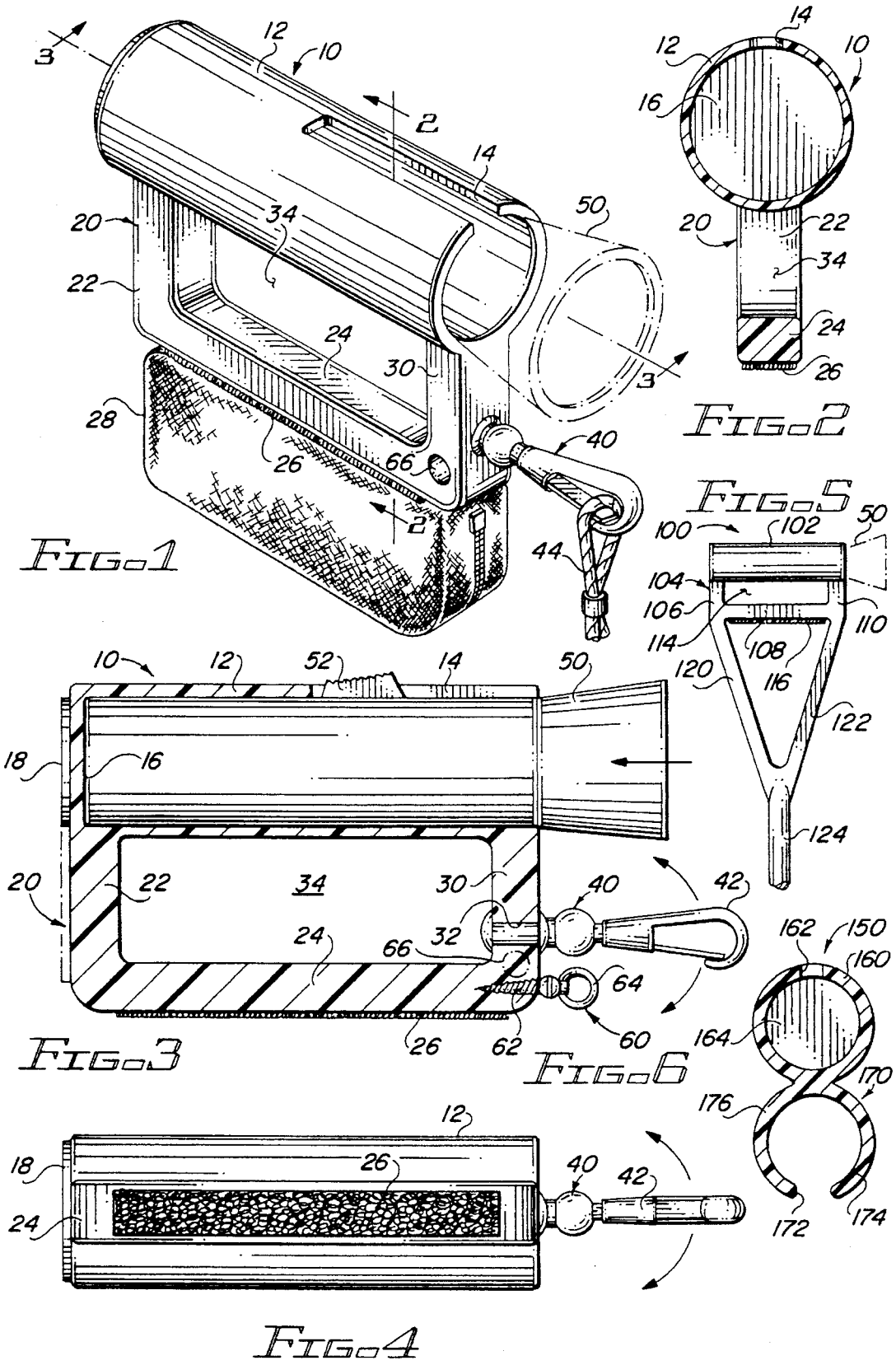
FIG. 1 comprises a perspective view of handle apparatus of the present invention.
FIG. 2 is a view in partial section taken generally along line 2—2 of FIG. 1.
FIG. 3 is a view in partial section taken generally along line 3—3 of FIG. 1.
FIG. 4 is a top view of the apparatus of the present invention.
FIG. 5 is a side view of an alternate embodiment of the apparatus of the present invention.
FIG. 6 is a view in partial section through another alternate embodiment of the present invention.

FIG. 1 comprises a perspective view of handle apparatus 10 of the present invention. FIG. 2 is a view in partial section taken generally through the handle apparatus 10 along line 2—2 of FIG. 1. FIG. 3 is a side view in partial section of the handle apparatus 10, taken generally along line 3—3 of FIG. 1. FIG. 4 is a bottom plan view of a handle apparatus 10. For the following discussion of the handle apparatus 10, reference will be made to FIGS. 1, 2, 3, and 4.

The handle apparatus 10 includes a top housing 12 which receives a flashlight 50. The housing 12 is illustrated as being of a generally cylindrical configuration. As such, the flashlight 50 preferably includes a cylindrical barrel which extends into the housing 12.

Extending longitudinally through the upper portion of the housing 12 is a slot 14. The purpose of the slot 14 is to receive a switch 52 of the flashlight 50.

The housing 12 for the flashlight 50 is preferably relatively small so that the hand of a user may conveniently be disposed about the housing 12. As such, the flashlight 50 preferably utilizes AA batteries. Obviously, if desired, a larger flashlight, such as one that uses C size batteries may also be used. In such case, the housing 12 would be larger, and the convenience may accordingly be diminished somewhat for users with relatively small hands. At any rate, the size of the housing 12 will be such as to receive a desired flashlight 50.

The housing 12 is closed by a rear end wall 16. A reflector 18 is disposed on the outside of the end wall 18.

The reflector 18 provides a safety measure from the rear. If desired, the reflector 18 may extend downwardly from the end wall 16 onto the rear arm 22 to provide an additional measure of safety. This is shown in dash dot line in FIG. 3.

Secured to, and extending beneath the housing 12 is hand guard portion 20 to which may be secured a purse or pouch 28 and a leash connector 40. The hand guard portion 20 includes a rear arm 22, a bottom arm 24, and a front arm 30. The configuration of the hand guard portion 20 of the apparatus 10 is of a generally rectangular configuration. Obviously, other configurations may also be utilized. The bottom arm 24 is generally parallel to the longitudinal axis of the housing 12. The rear arm 22 and the front arm 30 are generally parallel to each other, and are generally perpendicular to the bottom arm 24 and to the longitudinal axis of the housing 12.

Within the hand guard portion 20 and beneath the housing 12 is an open area 34. The open area 34 receives the fingers of the user of the apparatus 10. Essentially, the user's hand is disposed about the housing 12 and within the arms 22, 24, and 30 of the hand guard portion 20 and the user's fingers extend through the open area 34.

The pouch or purse 28 is preferably secured to the bottom arm 24 by hook and loop type fasteners. Accordingly one of the hook and loop fasteners 26 will be secured to the bottom of the bottom arm 24. The purse or pouch 28 may have the other, mating, elements for securing the purse or pouch 28 to the handle apparatus 10. Thus, the fastener element 26 may be either hook or loop, and the purse or pouch 28 may have the mating hook or loop element for securing the purse or pouch 28 to the handle apparatus 10.

Keys, change, etc., may be safely carried in the purse or pouch 28 by walkers, joggers, etc., who may be users of the apparatus 10.

The leash connector 40 comprises a swivel element appropriately secured to the front arm 30. The front arm 30 includes an aperture 32, best shown in FIG. 3, with the leash connector 40 extending through the aperture 32.

The leash connector 40 comprises a swivel element with a snap connector 42 to which a leash may be connected.

As is obvious, a leash for an animal, such as a dog, may be conveniently secured to the snap 42 of the leash connector 40 to secure the leash to the handle apparatus 10. Thus, while walking the animal at night, the user of the handle apparatus 10 holds on to the housing 12 in which is inserted the flashlight 50. The user may use the flashlight 50 as appropriate for illuminating the path or area that the user is walking along. The handle apparatus 10 accordingly requires only one handed use, leaving the user's other hand unencumbered.

An alternate leash connector 60 is shown in FIG. 3. The connector 60 comprises an element 62 appropriately secured to and extending into the bottom arm 24. The element 62 may be threadedly connected to the arm 24, if desired. A ring 64 is secured to the element 62. A leash may then be secured to the ring 64.

Another alternate leash connector, comprising simply an aperture 66, is shown in FIG. 1 and in FIG. 3. A leash (not shown), or any other appropriate connector element, may be directly connected to the handle apparatus 10 through the aperture 66. The aperture 66 is shown in dash dot line in FIG. 3.

An alternate embodiment of the handle apparatus 10 is illustrated in FIG. 5. FIG. 5 comprises a side view of a handle apparatus 100 which may be an integral part of a cane or walking stick.

The handle apparatus 100 includes a housing 102 in which is disposed the flashlight 50. The flashlight 50 is shown in dash dot line.

Beneath the housing 102 is a hand guard portion 104 which is substantially identical to the hand guard portion 20 of the apparatus 10. The hand guard portion 104 includes a rear arm 106, a bottom arm 108, and a front arm 110. Beneath the housing 102, and within the three arms 106, 108, and 110, is an open area 114 into which a user's fingers extend.

Beneath the bottom arm 108 is a fastener element 116. The fastener element 116 is substantially identical to the fastener element 26. A purse or pouch, such as the purse or pouch 28, may be secured to the bottom arm 108 through the fastener element 116.

Extending downwardly from the hand guard portion of the handle apparatus 100 are two diagonal braces 120 and 122. The diagonal brace 120 comprises a rear diagonal brace, and the diagonal brace 122 comprises a front diagonal brace. The braces 120 and 122 extend downwardly and inwardly from the hand guard portion and extend to a bottom strut or leg 124. The strut or leg 124 comprises a bottom portion of a cane or walking stick to which the handle 100 is secured and of which the handle 100 is an integral part.

FIG. 6 comprises a view in partial section through an alternate embodiment 150 of the present invention. The embodiment 150 comprises a double cylinder embodiment in which a top cylinder or housing 160 receives a flashlight, such as the flashlight 50, and a bottom cylinder 170 receives a tubular element on which the handle apparatus 150 is disposed. The tubular element to which the handle apparatus 150 may be secured may be a walker, a wheelchair, a bicycle, etc.

The upper cylinder 160 comprises a flashlight housing and it includes a slot 162, comparable to the slot 14 of the housing 12. The housing or cylinder 160 is closed by a rear end wall 164.

The bottom cylinder 170 includes a longitudinally extending slot 172 which divides the cylinder 170 into two flexible side portions 174 and 176. The portions 174 and 176 flex outwardly when a tubular element is received through the slot 172. The portions 174 and 176 then move inwardly to clamp onto the tubular element to secure the handle apparatus 150 to the tubular element of a bicycle, walker, wheelchair, etc.

If desired, the bottom cylinder 170 may be disposed other than parallel to the upper cylinder 160. For example, the bottom cylinder 170 may be disposed generally perpendicular to the upper cylinder 160 so as to be secured to a cross member of a walker or bicycle.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Handle apparatus comprising in combination:

a housing for receiving a flashlight and adapted to be grasped by a user;

a flashlight disposed in and removable from the housing;

a hand guard extending downwardly from the housing for receiving user's fingers; and an animal leash removably secured to the hand guard.

2. The apparatus of claim 1 which includes means for securing a pouch to the hand guard.

3. The apparatus of claim 1 in which the housing includes a slot for receiving a flashlight switch.

4. The apparatus of claim 1 in which the hand guard includes a rear arm secured to the housing, a bottom arm secured to the rear arm, and a front arm secured to both the bottom arm and the housing.

5. The apparatus of claim 1 which further includes leg means extending downwardly from the hand guard to define a walking cane.

6. The apparatus of claim 5 in which the leg means includes a leg and a pair of diagonal elements extending from the leg to the hand guard.

7. The apparatus of claim 1 which further includes a ring secured to the hand guard for receiving a leash.

8. The apparatus of claim 1 which further includes a reflector element.

9. The apparatus of claim 8 in which the reflector element is secured to the housing.

10. Handle apparatus for a flashlight comprising in combination:

a housing for receiving a flashlight and adapted to be grasped by a user;

a hand guard secured to the housing and through which a user's fingers extend;

an animal leash removably secured to the hand guard; and a flashlight disposed in and removable from the housing.

11. The apparatus of claim 10 which further includes an animal leash secured to the hand guard.

12. The apparatus of claim 10 in which the hand guard includes a first arm and a second arm secured to the housing and spaced apart from each other, and a third arm secured to the first and second arms spaced apart from the housing.

13. The apparatus of claim 10 which further includes a pouch secured to the third arm.

14. The apparatus of claim 10 which further includes a leg extending downwardly from the hand guard to define a walking stick.

* * * * *